United States Patent [19]

Walz

[11] 3,943,644

[45] Mar. 16, 1976

[54] MINING DREDGE HAVING ENDLESS BUCKET CONVEYOR AND FLEXIBLE GUIDE TRAIN

[76] Inventor: Alfons Walz, Alfons-Walz-Strasse 1-5, 7967 Bad Waldsee, Germany

[22] Filed: June 25, 1974

[21] Appl. No.: 483,068

[30] Foreign Application Priority Data

June 25, 1973 Germany ..... 2332198

[52] U.S. Cl. ..... 37/69; 37/DIG. 8; 198/109

[51] Int. Cl.[2] ..... E02F 3/08

[58] Field of Search ..... 198/109, 116, 130, 192 A; 37/55, 60, 69, DIG. 8; 43/6.5

[56] References Cited

UNITED STATES PATENTS

| | | | |
|---|---|---|---|
| 503,655 | 8/1893 | Ellicott et al. | 37/69 X |
| 506,592 | 10/1893 | Gullmann | 37/69 |
| 1,097,722 | 5/1914 | Lake | 37/55 |
| 2,022,300 | 11/1935 | Shaw | 37/69 |
| 2,363,251 | 11/1944 | Jurisich | 37/55 |
| 3,305,950 | 2/1967 | Hirshman et al. | 37/DIG. 8 |
| 3,672,079 | 6/1972 | Masuda et al. | 37/69 |
| 3,675,348 | 7/1972 | Dane, Jr. | 37/69 |

FOREIGN PATENTS OR APPLICATIONS

| | | | |
|---|---|---|---|
| 694,589 | 9/1964 | Canada | 37/69 |
| 1,239,178 | 7/1971 | United Kingdom | 37/69 |

*Primary Examiner*—Clifford D. Crowder
*Attorney, Agent, or Firm*—Joseph A. Geiger

[57] ABSTRACT

A device for mining the bottom of a body of water for ores and minerals, having a flexible combined guide train and conveying train assembly suspended between a drive unit on board a ship and a receiving unit. The latter is towed along the bottom, so as to scrape or scoop up the wanted materials, by means of the resiliently stretchable combined train assembly. This assembly comprises synthetic rope strands in both the guide train assembly and the conveying train, guide units being spaced along the guide train assembly for the interference-free guidance of the conveying buckets attached to the multiple strands of the conveying train. The receiving unit, equipped with various monitoring sensors, is also linked to a buoy, by means of which it can be raised for transport and repositioning.

41 Claims, 20 Drawing Figures

MINING DREDGE HAVING ENDLESS BUCKET CONVEYOR AND FLEXIBLE GUIDE TRAIN

BACKGROUND OF THE INVENTION

1. Field of the Invention

The present invention relates to devices for undersea mining, and in particular to devices adapted for the extraction and upward conveyance from the bottom of a body of water of such deposits as ore nodules, mineral soaps, and ore sludge.

2. Description of the Prior Art

In cases where deposits are to be extracted from shallow water depths, the most commonly used extraction devices, besides suction dredges, are such mechanical devices as scoop dredges, grab bucket dredges, and bucket chain dredges, the extracting operation being performed in almost all cases without the use of a separate receiving unit placed on the bottom of the water course. Chain dredges have an advantage under these conditions, becuase they are simple in construction and easy to supervise, while the materials are conveyed upwardly in a continuous operation and extracted in a uniform manner along a predetermined path of advance. This type of prior art device normally has an endless bucket chain moving around a chain drum mounted at the far end of a swivel arm. The two chain strands move on the upper and lower side of the swivel arm, so as not to interfere with each other.

In the case of mining operations in greater water depths, preference has been given in the past primarily to the hydraulic conveyance of the materials, the latter being fed to the conveying unit from a receiving unit which moves along the ocean floor. One shortcoming of these devices is that they are too complex and therefore subject to frequent breakdown, in addition to the fact that they are comparatively inefficient.

Another type of prior art device employs as a conveying device a cable loop running between cable pulleys, one pulley being arranged on board a ship or on board some other suitable carrier floating on the surface, the other pulley being mounted on a mobile receiving unit on the ocean floor. Such a conveyor may use two conveying baskets moving in a shuttle-type operation, an arrangement which is suitable only for relatively shallow water depths, or it may have a series of buoyant carriers which move in a rotating operation. However, both the design and the necessary controls for this type of buoyant carrier are comparatively complex, so that they, too, are subject to frequent operational problems, in addition to the relatively low conveying capacity of the buoyant carriers. Lastly, the conveying cables lack any positive guide between the reversal points at the cable pulleys, making it possible for the conveying baskets to collide with each other in mid-course.

In order to avoid the last-mentioned problem, it has already been suggested to use a cable loop system with a series of pivotably attached carrying baskets in which the cable loop runs downwardly from the bow of the ship and returns at the stern of the ship, over appropriate cable guide means, a large length portion of the cable loop being dragged along the ocean floor, as a result of the lateral drift of the ship (U.S. Pat. No. 3,672,079). This system, however, is subject to the risk that even small obstacles encountered on the ocean floor may cause the conveying cable to become hooked, resulting in possible damage or even rupture of the cable.

SUMMARY OF THE INVENTION

The present invention relates to an improved device for mining from the bottom of a body of water such deposits as ore nodules, mineral soaps, and ore sludge, by means of a bucket conveyor system in which the buckets are attached at predetermined intervals to continuously moving endless strands of a conveying train which is suspended from and driven by a drive unit carried on a vehicle.

It is a primary objective of this invention to devise an improved system, or systems, of the aforementioned type in which the conveying train is not subject to interference between descending and ascending strands, and in which obstacles encountered on the bottom of the body of water have a minimal influence on the conveying train, while the latter assures a reliable extraction and upward conveyance of the materials from varying depths of water.

In order to attain this objective, the present invention suggests a system in which the carrying vehicle is linked through a flexible guide train assembly with a receiving unit positioned on the bottom of the body of water, the guide train assembly including appropriate guides for the descending and ascending strands of the conveying train, whereby the latter is guided around a reversing drum mounted on the receiving unit.

In the suggested system, the guide train assembly fulfills a function which is analogous to the function performed by the swivel arm of a conventional bucket chain dredge. However, since the reversing drum is mounted on a separate receiving unit placed on the sea floor, the system features a single flexible link between the drive unit and the receiving unit, each strand of the conveying train being guided along a separate path determined by the guide train assembly, so that interference with other strands is impossible. Variations in the water depth are accommodated through an appropriate longitudinal displacement of the vehicle in relation to the receiving unit. The vehicle in question, for instance a ship, or a wheeled carrier running on a bridge, can therefore basically be located vertically above the receiving unit, or it may be laterally offset in relation to the receiving unit by a distance taking into account the water depth and the length of the guide train and conveying train assembly. In all situations it is thus possible to position the guide train and conveying train assembly in such a manner that the latter will not sag to the bottom in front of the receiving unit. The conveying buckets, therefore, contact only the material on the bottom of the water which is scooped up, making it possible to guide the buckets along an exact path both in the scooping run on the receiving unit and on the emptying run on the drive unit. The result of such an arrangement is that the buckets themselves, as well as the separate strands of the guide train assembly and of the conveying train are handled with great care, inspite of the flexible link which they constitute between the receiving unit and the drive unit, and that these elements are subjecteed only to comparatively moderate stress during operation. Since no lateral drifting motion takes place, the only risk to be watched for is that the path of the combined flexible train is kept free of obstacles. This is normally no serious problem, because it is possible with this system to operate with very small angles of inclination.

It should be understood that the term "ship" is employed for the sake of expediency, and that this term is meant to imply any suitable floating carrier for the drive unit. Thus, the latter may be supported on a pontoon, on a pontoon bridge, on a catamaran, or on any suitably constructed floatable platform. Because of the flexibility of the entire combined guide train and conveying train assembly, it would be possible, at least in principle, to lower the receiving unit from the ship which carries the drive unit. However, this approach is comparatively complicated and costly, if it is desired to place the receiving unit on a particular predetermined place of operation. The invention therefore further suggests that the receiving unit be connected to a second floatable body, for instance a buoy, by means of a tensile connection suitably dimensioned for the weight of the receiving unit. In cases where the second floatable body has adequate carrying capacity, the receiving unit can be lowered directly from the latter. In most cases, however, it suffices to use a buoy which is capable only of carrying the weight of the tensile connection. This buoy, in turn, can then be picked up by a second ship or boat, thereby raising or lowering the receiving unit. No special lifting device is necessary in this case, because it is sufficient to horizontally displace the buoy-controlling boat, in order to raise or lower the receiving unit with respect to the ocean floor. This simple maneuver can be used, if the receiving unit is to be repositioned, or if it is to be freed, after being somehow blocked in position. The tensile connection should therefore be attached to the receiving unit at such a point above its center of gravity that the unit remains oriented substantially horizontally, at least in the lateral direction, when raised by the buoy. Another possibility for achieving an approximate horizontal orientation of the raised receiving unit is given by appropriate placement of the attachments on the receiving unit for the guide train and conveying train assembly and for the tensile connection. This arrangement makes it possible to raise the receiving unit almost to the surface of the water so that the ship, with its attached train assembly, receiving unit and tensile connection, and the buoy-controlling boat, constitute a single tow train which, with the possible exception of the buckets themselves, can be assembled near the coast or in shallow water, and which can then be transported to the place of use. The various strand members of the guide train assembly and of the conveying train may be selected from a variety of possible alternatives. One may choose members of homogeneous cross section, such as cables or chains. However, most satisfactory results have been obtained with multi-filament members, such as woven ropes or tapes having at least approximately the same stretch ratios, when used for both the guide train assembly and the conveying train. Together, the two trains thus form a tension-resistant supporting and towing connection between the ship and the receiving unit. Because of the possibility of using woven tapes as ropes, and because the ropes used are most commonly round ropes, the strand members will hereinbelow be variously referred to as "ropes".

The strands of the guide train assembly and of the conveying train (guide strands and conveying strands, respectively) are preferably manufactured of a tension-resistant synthetic material such as polypropylene or polyamide, particularly nylon. Among the known raw materials of this type are several materials which have adequate salt water resistance, being capable of withstanding the forces exerted on such a system, and which have the additional advantage that their density is approximately identical to that of the ambient water, or even smaller. The total underwater weight of the flexible train assembly is thus determined almost exclusively by the combined weight of the conveyor buckets and of the materials they carry upwardly.

The materials for the guide strands and conveying strands may also be reinforced with special high-tensile fibers of special composition, such as glass fibers, carbon fibers, or the like, without substantially changing the weight of the strand members. Such reinforcement not only greatly increases the resistance of these strands, it also reduces their stretchability. However, a certain degree of stretchability should be available, in order to reduce the risk of sudden surges of tension along the guide train and conveying train assembly, when the distance between the ship and the receiving unit changes for some reason or other.

The endless conveyor preferably has an even number of parallel conveyor strands, the conveyor buckets being arranged between the spaced strands and attached thereto by means of special bucket attachments. The latter are fixedly connected to the several conveying strands, having a profile which allows them to be guided between oppositely spaced guide rollers arranged in special guide units. This configuration makes it possible to assemble a complete guide train assembly and a conveying train by initially only attaching the bucket attachments to the conveying strands, leaving off the much heavier conveying buckets themselves. The resulting advantages available in connection with a towing operation of the assembly, thanks to the buoyancy of the latter, are obvious. Only after the assembly has thus been towed to the place of use, are the conveying buckets connected to the bucket attachments, by advancing the conveying train step by step past a point of assembly.

The invention further suggests that the conveying buckets be guided during the scooping operation, as they move around the reversing drum and through the accummulated materials, while being suspended from the conveying strands, after which they ascend along the guide train assembly, by means of which they are guided on board ship or on board another suitable carrier vehicle. Because it is often the case that the conveying train runs at a fairly shallow angle, especially in the area of the receiving unit, it may be advantageous to provide a limited degree of pivotability of the conveying buckets on their attachments. This pivotability allows the filled buckets to freely assume a somewhat steeper suspended orientation, thereby preventing the scooped-up materials from being partially discharged again outside the receiving unit.

The conveying train is preferably guided along the guide train assembly by means of several spaced guide units disposed at intervals along the guide train assembly. Each of these guide units may consist of a guide cage to which the guide strands are firmly clamped and which includes at least one guide roller journalled between supporting brackets, the guide roller, or rollers, having appropriate grooves for the conveyor ropes. Also arranged in each guide unit are oppositely aligned cantilever-type retaining rollers spaced such a distance from the guide roller grooves that they prevent the ropes from jumping their grooves, while accommodating the profile of the bucket attachments. The several guide strands are preferably releasably clamped to the outer sides of the lateral brackets of each guide unit.

In a particularly advantageous embodiment, the bucket attachments are shaped in the form of a "T", the central ridge of the T-profile serving as an attachment point for the conveying bucket, whereby the earlier-mentioned cantilever-type retaining rollers are so arranged that the central ridge of the bucket attachment passes between their free ends and the flange portion of the bucket attachment, itself attached to the conveying strands, moves over the guide roller and under the two retaining rollers.

The guide cage may form an assembly comprised of two oppositely oriented, ridgedly connected lateral cage brackets on which the guide rollers and the retaining rollers are journalled. The two lateral brackets are preferably connected to each other by means of threaded spacer rods which may at the same time serve as a bearing support for a guide roller.

For obvious reasons, these bearing cages should form fairly stiff assemblies, the components being preferably made of light metal. However, it is also possible to fabricate at least the guide rollers and retaining rollers partially or entirely from a suitable, wear-resistant plastic material, in the form of hollow bodies. By thus judiciously designing the guide units for minimum submerged weight, it is possible to obtain a complete train assembly which, without conveying buckets, is almost floating in the water. A certain limited weight should be left, however, so that the train assembly remains sufficiently submerged, even in towing configuration, to avoid destruction thereof by wave action in a storm.

Instead of using only a sigle row of conveying buckets, it is also possible to use several rows of buckets, each bucket having preferably a separate bucket attachment on the conveying train, while the several conveying trains are guided over a common drive drum and a common reversing drum. However, when using such an arrangement with multiple conveying units and separate conveying strand loops, it is advisable to laterally interconnect at least some of them by means of common, or cross-connected guide units. It was found to be preferable to use in this case several, if possible identical and separately driven drive units on board ship and likewise separately journalled reversing drums on the ocean floor. This makes it possible to continue operations, even though one of the conveying units may be broken down, or otherwise stopped.

In almost all cases only a single receiving unit will be used in association with one ship; the receiving unit may, however, carry several reversing drums with appropriate scooping means. A single receiving unit of this type greatly enhances the maneuverability and the supervision of the system. Yet, in cases where the ocean floor to be harvested is very flat and where a maximum width is to be covered in a single pass, it might be advantageous to use several independently moving receiving units, the latter being preferably arranged in a staggered formation.

The receiving unit is preferably constructed around a rigid supporting frame resting on the ocean floor by means of at least two laterally spaced skids and including between the skids a bearing pedestal for the reversing drum whose periphery runs at least close to the materials which are to be conveyed. It is of course also possible to provide special means designed for transferring the materials into the conveying buckets. It is more simple and preferable, however, to use the buckets, which are positively guided by the receiving unit, to directly engage the loose materials and to thereby scoop them up. Thus, one may choose the path of the buckets in the range of the reversing drum so as to reach approximately to the normal support plane of the skids, i.e. below the level of the ocean floor.

In order to prevent any risk of damage to the buckets under these circumstances, it is preferable to laterally protect their path by means of wall panels which reach somewhat deeper than the bucket path.

If the material to be extracted consists of manganese nodules or similar relatively large solid lumps resting on a softer support, it may be advantageous to arrange on the front end of the supporting frame a scraping device which leads into a collecting ramp leading in turn to a scooping or loading trough in that portion of the bucket path which is defined by the lower arc of the reversing drum. This special scraping device detaches the nodules from their surrounding material, a major portion of the latter, to the extent that it is of smaller grain size, being dropped again. This preliminary sorting procedure can be followed by a second sorting operation, by designing the conveying buckets in such a way that at least their bottom is perforated in the manner of a sorting screen, the size of the openings determining the smallest diameter of the solid bodies which are to be retained and collected. As the buckets ascend to the ship, they are then continuously rinsed, thereby largely washing out the sand which may have been been scooped up with the nodules. This sorting procedure improves the ratio of total weight of materials collected to net weight of usable materials extracted.

The scraping unit may comprise a great number of parallel scraping fingers reaching forwardly in the direction of advance in a closely spaced formation, the fingers being upwardly adjustable in relation to each other. This adjustability of the scraping fingers allows the scraping device to adapt to the unevenness of the ocean floor surface so as to produce an approximately even depth of penetration over the entire width of the device.

In order to achieve this result, the separate scraping fingers are slightly slanting downwardly in the forward direction and are pivotably supported on a common transverse axis near their rear extremity, the range of pivotability being limited, in at least the downward sense, by means of an abutment profile. While this abutment profile prevents an excessive downward opening of the scraping fingers, an excessive upward opening can be prevented by giving each scraping finger a rear length portion extending from the transverse pivoting axis a distance of approximately 15 to 35 percent of the forward length of the fingers. Thus, when a scraping finger is raised too high, the rearwardly extending finger portion has to penetrate into the ocean floor accordingly, thereby tending to restrict the upward motion of the scraping finger and to return it downwardly, as the receiving unit advances.

Just above the collecting ramp and in front of the scooping range of the buckets is preferably further arranged a sensing device which gives a remote reading of the height of the material stream passing over the collecting ramp, the sensing device being, for example, a pendulum-type sensing gate suspended from a pivot point and swinging backwardly with the material stream. The motion of the sensing gate is converted into an electronic signal by means of a potentiometer. The resulting reading, indicating the volume of materials arriving on the collecting ramp, can be used as a reference value for adjusting the speed of advance and the velocity of upward conveyance. Thus, if the material stream depth is excessive, one may either increase the lineal speed of the bucket train or reduce the towing speed of the boat accordingly. Provision may also be made for an automatic adjustment of the conveying speed in response to the material stream depth.

The preferred embodiment suggests further that the collecting ramp includes lateral retaining walls forming a funnel-type, tapered entry toward a central longitudinally extending scooping trough of the receiving unit into which the conveying buckets dig as they pass from above and behind the reversing drum to the bottom sector of their reversing path. The scooping trough may be open on its rear end so as to permit the free passage of material which has not been scooped up, in order to avoid any undesirable buildup.

The guide train assembly is preferably so attached to the supporting frame of the receiving unit that, when its angle to the unit is steep, the latter is not lifted up and, when the angle of connection is flat, it does not exert too much of a tilting moment on the receiving unit. However, since at least the forces of the conveying train are transmitted to the receiving unit at the comparatively elevated level of the reversing drum axis, the supporting frame should preferably extend a certain distance behind the reversing drum and carry an appropriate ballast on that end. A similar counter-weight may be necessary on the forward portion of the receiving unit, in order to obtain at least some contact pressure against the ocean floor, even when the angle of attachment of the train assembly is unfavorable.

The contact between the supporting frame and the ocean floor is preferably distributed over three contact points, two of the points being laterally spaced supporting skids on the front portion of the frame, and the third point being a central supporting skid on its rear portion. The transverse tilt is thus determined exclusively by the two front skids so that the scraping device is always oriented in accordance with the angle of the surface being worked. All other parts of the receiving unit are preferably arranged to have a certain ground clearance, the latter being determined by the carrying capacity of the ocean floor. This arrangement thus minimizes any damage to the receiving unit from upwardly projecting obstacles.

At least the rear skid may also be provided with a swivelling capability which may be combined with appropriate steering means. In the preferred embodiment of the invention, the receiving unit is sub-divided into a bottom part, including at least the supporting skids, and an upper part with the reversing drum, the two parts being connected to each other by means of a swivel connection. This design has the additional advantage that the reversing drum is permitted to align itself with the direction of pull on the combined train assembly, thereby preventing any risk of the conveying buckets becoming caught on the receiving unit and of the conveying strands jumping the reversing drum. This arrangement may also include remotely controlled adjustment devices responding to measurements of the degree of misalignment between the upper and lower parts of the receiving unit.

The receiving unit is appropriately also provided with an impact-resistant peripheral skirt surrounding it at a distance above the contact plane of the supporting skids, the peripheral skirt being tapered in its front portion in the manner of the bow of a ship. The primary purpose of this peripheral skirt is to serve as a deflector against protruding obstacles. Any impact forces thereby created on the peripheral skirt are transmitted directly to the supporting frame, while other, more sensitive parts of the receiving unit remain uneffected. Collision with a large obstacle can therefore produce a corresponding lateral deflection of the receiving unit. Thus, a receiving unit may travel along a serpentine path between protruding rocks and the like, while the main towing direction remains unchanged. In a situation where the transverse distance between obstacles is too small for the passage of the receiving unit therebetween, the latter may become stuck, with the result that the forces in the train assembly increase, the rate of increase depending upon the modulus of elasticity of the combined guide train and conveying train assembly. This increase is normally very gradual, because the overall length of the train assembly is very large in relation to the speed of the towing advance.

In order to provide a means for the early discovery of a situation in which the advance of the receiving unit is completely blocked, the peripheral skirt of the latter may be provided, at least on its forward and lateral portions, with appropriate sensors which indicate on an on-board monitoring panel the existence of contact pressure between an obstacle and the peripheral skirt. A preferred version of such sensing means consists of pressure-sensing units arranged at certain intervals on the outside of the peripheral skirt.

Signals received from these sensors, especially the reception of several simultaneous signals, inform on-board operating personnel of any collisions between the receiving unit and ocean floor obstacles. Should the situation occur that the receiving unit is blocked in its advance, then it becomes necessary to reverse the ship, in order to first relax the entire train assembly, whereupon the receiving unit can be repositioned by means of the tensile connection linking it with the buoy. These corrective maneuvers can normally be executed, before permanent damage is suffered by either the train assembly or the receiving unit. In order to further reduce the risk of damage to the receiving unit, the latter may also be provided with one or several upwardly extending protective members which prevent a roll-over of the unit around its longitudinal axis.

When mineral soaps and ore sludges are to be mined, the conveying buckets are preferably imperforate or they may be provided with a fine-mesh screen on their bottom, in order to prevent the loss of any valuable materials. In this context, is was found to be advantageous to provide the conveying buckets with hinged covers and to arrange special guide means on the receiving unit for holding the covers open during the scooping operation. A preferred version of such an arrangement includes a lateral nose or pin on each hinged cover engaging a guide rail which extends parallel to the periphery of the reversing drum. After leaving this guide rail at the end of the scooping range, the hinged covers are then permitted to close automatically by gravity or with the help of a spring, the closed covers being opened again in the emptying range on the drive unit.

A modified receiving unit is preferably used when mineral soaps, rather than ore nodules, are to be harvested from the ocean floor. In this case, the supporting frame of the receiving unit includes preferably at least one scraping trough arranged between the reversing drum and a guide drum for the conveying strands, which guide drum is disposed a distance forward of the reversing drum. Within this scraping range, the conveying buckets are guided substantially parallel to the ocean floor, reaching directly into the deposited materials, but at a level which is slightly higher than the adjacent vertical runners serving as protective lateral walls for the scraping trough. Since it is not normally desirable to provide a funnel-type forward opening on the scraping trough, it may be desirable to arrange several parallel scraping troughs and bucket trains adjacent to each other.

When sludgy material such as ore sludge is to be extracted, it may be preferable not to have any horizontal advancing motion on the receiving unit. In this case, the supporting frame of the unit would be designed as a grid of frame members which is open in the vertical direction, the supporting members being preferably in the form of vertically oriented flat profiles. The supporting frame is merely deposited on the ocean floor on an approximately horizontal level. The train assembly can then extend comparatively steeply from the receiving unit, the latter being appropriately stabilized in position by means of suitably placed counterweights. As the conveying train is operated, the sludge enclosed within the grid frame of the receiving unit is scooped up, the unit sinking deeper and deeper into the ground and forming a sort of crater, so that additional sludge flows into the latter from the surrounding area of the ocean floor. This method permits the harvesting of large sludge fields, without the need for any repositioning of the receiving unit.

The drive unit of the preferred embodiment of the invention includes a drive drum supported by a horizontal shaft which is carried on a supporting frame reaching laterally over the ship's side in the manner of an outrigger. Where only a single drive unit is provided, this supporting frame may be arranged to reach over the stern of the ship. But when several drive units are provided, it is preferable to use overhanging frames on both sides of the ship reaching out far enough to prevent the train assemblies from being slammed against the ship's planks in a storm. In the case of several drive units being provided on one side, the latter should be spaced sufficiently in both the longitudinal and in the transverse sense.

In order to facilitate the discharge of the extracted materials, the lateral groups of conveying trains may be spaced in accordance with the transverse dimensions of the conveying buckets. Below the drive drum is preferably arranged a conveyor for the transfer of the discharged materials. Given the case that the preferred rope material is stretchable synthetic material, it may be advantageous to provide the annular grooves on the drive drum with tapered flanks engaging the ropes in the manner of a V-belt, in order to generate the necessary friction between the drum and the ropes. If, under these circumstances, the pull on the descending strands is insufficient to disengage the strands from the drum grooves, a simple release roller may be arranged between the drive drum and the descending rope strands.

The drive unit should advantageously be designed as a self-contained, removable assembly unit with a frame supporting the drive drum and at least one drive motor, the unit being detachably mounted on the vehicle. This arrangement makes it possible to simply attach one or several drive units by means of suitable mechanical mounting elements and to connect the units to a suitable power supply.

It may be desirable to provide a swivelling capability between the frame element of the drive unit carrying the drive drum and the vehicle, or to arrange the entire drive unit in such a way that it is adjustable around a vertical pivot axis on the vehicle. The advantage of such an arrangement is that the drive drum is permitted to align itself with the direction of pull on the train assembly, thereby facilitating a change in the ship's course, so that the receiving unit can be towed along a comparatively narrow radius.

The invention further suggests that the guide train assembly include several stretch sensors which are connected to indicating instruments on board ship. This can be accomplished, for example, by providing on the guide train assembly at least one tensile member having a stretch ratio which is less than that of the guide train assembly, the tensile member being connected on board ship to a yielding indicating device such as a spring loaded drum. Since any tension load on the guide train assembly quickly spreads over the entire train length, it is normally sufficient to attach the lower end of this tensile member to the uppermost guide unit of the assembly.

On board ship is also preferably arranged a suitable control panel, combining on it at least the indicating devices for train assembly elongation, possibly also for its angle of slant, indicators for obstacle contact, and an indicator for the height of the material stream on the receiving unit. This makes it possible to observe all these critical values from the bridge or from another suitable command post on board ship and to quickly take all necessary reactive measures, such as stopping or reversing the ship, as soon as characteristic danger signals are received. Even in the case where all electrical connections to the receiving unit should fail, it is still possible to continue a largely risk-free extraction and conveyance operation, by only monitoring the stretch values measured on the guide train assembly.

According to a still further suggestion of this invention, a train assembly consisting of several parallel multi-filament ropes may be provided with regularly spaced transverse connectors or spokes, in the manner of a rope ladder. In a preferred version of this arrangement, the transverse connector includes a central spoke rod extending through the several rope strands and forming a firm connection therewith, the spoke rod being of a highly resistant material, such as steel. Between the rope strands, as well as on the extremities of the spoke rod, are preferably placed special caps with prongs penetrating into the rope, spacer sleeves being provided between the caps of adjacent rope strands.

These transverse spokes have the additional advantage of representing a very convenient means of improving the drive connection between the conveying train and the drive drum, by making it possible to arrange on the latter, between its annular grooves for the rope strands, suitable longitudinal engagement means cooperating with the transverse spokes in a positive fashion. These engagement means may consist of a series of successive longitudinal grooves or depressions on the drive drum, or the latter may include separate mechanically movable parts arranged on its periphery in the manner of a chain, for example, which, yielding to the contact pressure of the conveying train, form a suitable depression. The drum parts in question may also be arranged to yield radially, in order to add to the friction engagement the desired positive drive engagement.

In the aforementioned preferred embodiment it is further suggested that the conveying buckets be connected to the conveying train between the rope strands, using the transverse spoke as bucket attachment means, and thereby eliminating the need for any special attachment elements.

BRIEF DESCRIPTION OF THE DRAWINGS

Further special features and advantages of the invention will become apparent from the description following below, when taken together with the accompanying drawings which illustrate, by way of example, several embodiments of the invention represented in the various figures as follows.

DESCRIPTION OF THE PREFERRED EMBODIMENTS

Figure 1:
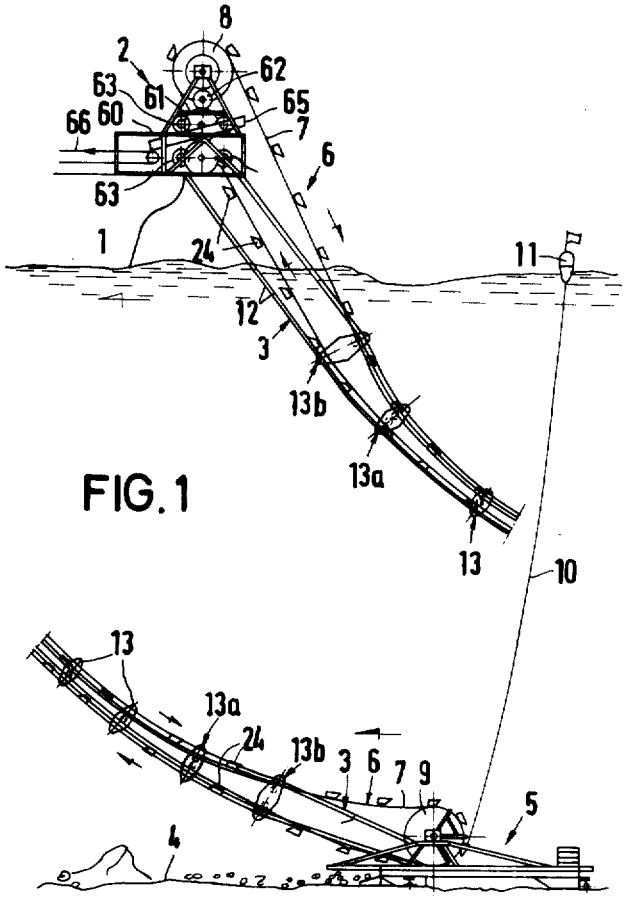
FIG. 1 shows, in a somewhat schematic representation, a side view of a device embodying the invention, which device serves for the extraction and upward conveyance of materials such as ore nodules, from the ocean floor.
Figure 2:
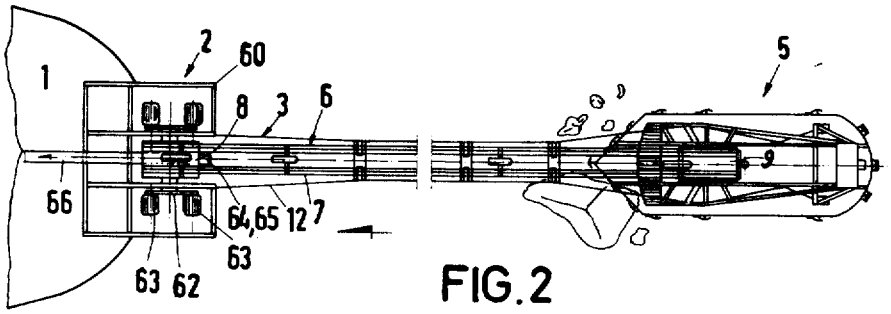
FIG. 2 is a plan view of the device of FIG. 1.

Referring to FIGS. 1 and 2, there is illustrated the stern of a ship or of another suitable floating vessel 1, and mounted on the latter is a drive unit 2 extending rearwardly over the rail of vessel 1. A flexible guide train assembly 3 extends from the drive unit 2 to a receiving unit 5 arranged on the ocean floor, or on the bottom of some other body of water. Another flexible connection between the ship and the receiving unit, generally designated by numeral 6, serves as a conveying train, the endless strands 7 of this train running from a drive drum 8, journalled on a horizontal shaft of the drive unit, to a reversing drum 9 of the receiving unit, which is similarly journalled on a horizontal shaft. The receiving unit 5 is further provided with a tensile connection 10 linking it to an overhead buoy 11. Normally, the carrying capacity of the buoy is sufficient only to carry the submerged weight of the tensile connection. However, the buoy and the tensile connection should be strong enough so that, when they are raised out of the water, they can carry the entire receiving unit and the attached portion of the combined guide train and conveying train assembly.

The guide train assembly is essentially composed of four guide strands 12 to which are attached, at regular intervals of approximately 20 to 50 meters, guide units 13, 13*a*, and 13*b*.

Figure 3:
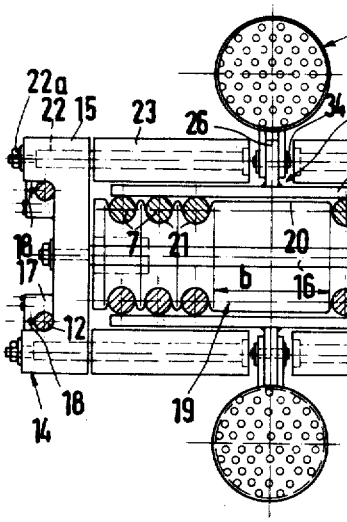
FIG. 3 shows a greatly enlarged end view of a guide unit of the invention, as part of a combined guide train and conveying train assembly extending between the drive unit and the receiving unit, the guide unit shown having only one guide roller.
Figure 4:
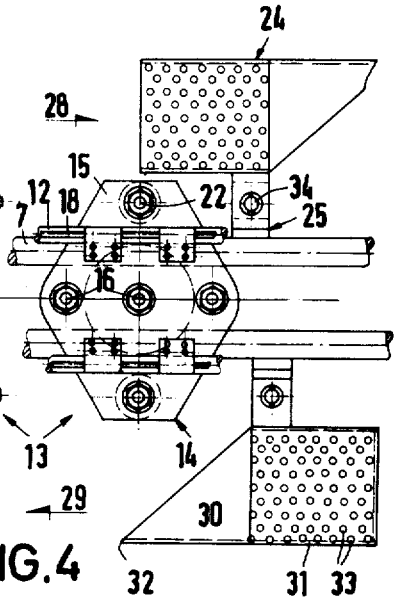
FIG. 4 shows a front view of the guide unit of FIG. 3, as mounted on said train assembly.

A complete guide unit 13 is illustrated in detail in FIGS. 3 and 4, consisting mainly of a guide cage 14 whose two lateral brackets 15 are rigidly connected to each other by means of threaded spacer rods 16. The guide strands 12 which link the several guide units together are attached to the outer sides of the brackets 15 by means of clamping shoes 17. These clamping shoes may also accommodate electrical cable connections 18 and/or other suitable strands linking the receiving unit with the drive unit.

Between the lateral brackets 15, and journalled on the central spacer bolt 16, is arranged a freely rotating guide roller 19. The latter has on each longitudinal end portion three annular guide grooves 21 for the upper and lower strands of a total of six conveying strands 7, the guide grooves 21 adjoining an intermediate cylindrical portion 20. Overhanging the guide grooves 21 are arranged parallelly journalled and oppositely aligned, but spaced-apart pairs of smaller retaining rollers 23, the latter being supported by cantilever-type bearing pins 22 which are fixedly attached to the brackets 15 by means of clamping nuts 22*a*. The retaining rollers 23 thus define a peripheral gap in relation to the guide roller 19, as well as a central transverse gap between each pair of aligned rollers 23.

To the six parallel conveying strands 7 are connected, at regular longitudinal intervals, a series of scraping and conveying buckets 24. The connection between the strands 7 and a bucket 24 is obtained by means of a special bucket attachment 25, the latter having a T-shaped profile, its central ridge 26 fitting into the central gap between the aligned retaining rollers 23, while its flange portion 27 fits into the peripheral gap between the guide roller 19 and the retaining rollers 23. The flange portion 27 of the bucket attachment 25 is directly attached to the six conveying strands 7, using conventional attachment clips or the like (not shown). These clips may be a part of the flange portion 27. It is important that the peripheral distance *a* between the guide roller 19 and the retaining rollers 23 is always smaller than the diameter of the conveying strands, in order to positively prevent the latter from jumping the guide grooves 21; it must be large enough, however, to permit the free passage of the flange portion 27 of the bucket attachment 25.

The conveying buckets 24 are cylindrical in their overall outline, the diameter being somewhat smaller than the length *b* of the intermediate cylindrical portion 20 of the guide roller 19. Each bucket has an imperforate scooping collar 30 on its forward portion, in the sense of bucket motion, and a basket portion 31 forming a rearward continuation thereof. The scooping part 30 has a scraping edge 32, inclined at an angle of approximately 45°. The basket portion 31 of the bucket is preferably fabricated of perforated sheet metal, having a number of straining perforations 33 in its cylindrical peripheral wall and in its bottom wall.

Figure 7:
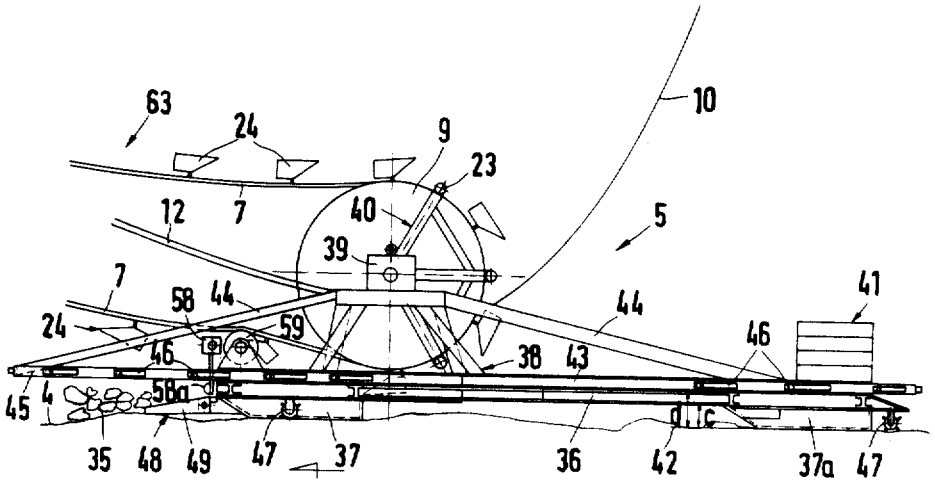
FIG. 7 shows the receiving unit of the embodiment of FIG. 1 in an enlarged elevational view.
Figure 8:
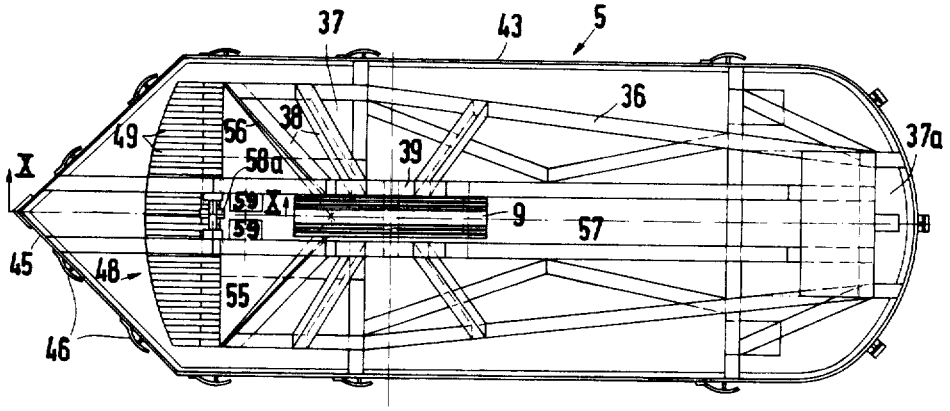
FIG. 8 is a plan view of the same receiving unit.

The conveying buckets 24 are readily attachable and detachable from the special bucket attachments 25 by means of a pivot pin 34 extending through appropriate ears on the bucket and through a bore in the central ridge 26 of the bucket attachment 25. This connection is preferably also so arranged that it allows the bucket to execute a limited pivoting motion of some 15 to 30 degrees angle relative to the conveying strands 7 (compare FIG. 7).

In the preferred embodiment, both the guide strands 12 and the conveying strands 7 are woven ropes of synthetic material, the rope fibers being made of polypropylene or polyamide, especially nylon, and the density of these ropes being normally just slightly less than the density of seawater. These ropes, or similarly constructed guide and conveying strands, may also be reinforced with special reinforcement fibers, especially glass fibers. In all cases, however, it is important that the guide strands and the conveying strands have the same stretch characteristics. Since the electrical cables 18, or similar auxiliary strands, have different stretch coefficients, they require suitable stretch compensating means between the guide units 13 to which they are attached. To accommodate this requirement in a most simple manner, the cables 18 may include helical length portions permitting such stretching, or they may simply be provided with sufficient slack between the guide units.

Both the guide rollers 19 and the retaining rollers 23 may be made of wear-resistant plastic material. Only the guide cage 14 itself should be of a seawater-resistant light metal alloy, in combination with threaded spacer rods 16 of stainless steel. However, in place of the lateral brackets 15 which are connected by the aforementioned spacer rods 16, it is also possible to use a modified guide cage in which the spacer rods are replaced by transverse integral extensions of the brackets, the latter being either split in the center of the guide unit, or cast as one single piece. In this manner, it is possible to construct a complete guide train assembly which is extremely light and which almost floats in the water. Only when the buckets 24 are attached to the conveying strands 7, is the combined guide train and conveying train assembly somewhat more weighted, but not to the extent that sizable supporting forces are necessary on the drive unit. Thus, any weight strain applied to the train assembly is due only to the buckets 24 and to the materials conveyed therein. But, because the buckets are arranged for easy connection and removal by means of the pivot pins 34, they make it possible to attach the buckets to the train assembly only shortly before startup of a mining operation.

Figure 5:
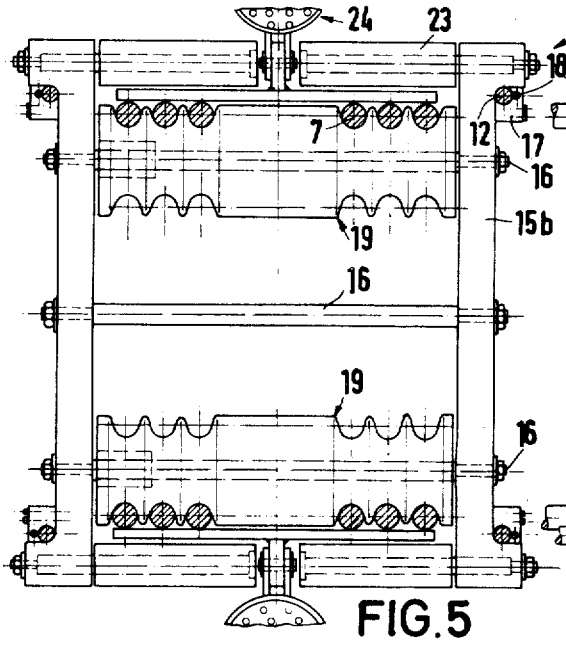
FIGS. 5 and 6 are similar to FIGS. 3 and 4, showing a modified guide unit comprising two spaced guide rollers.
Figure 6:
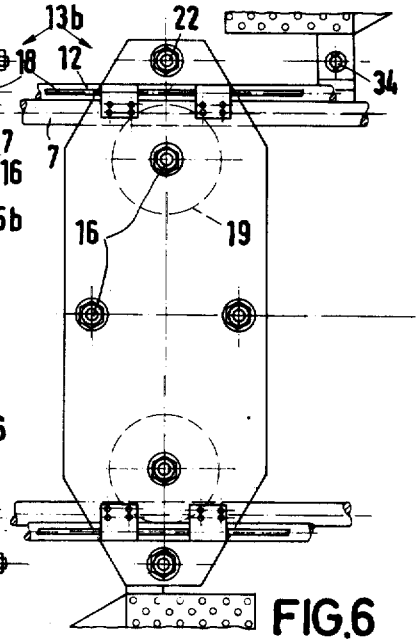

The modified guide units 13*a* and 13*b*, of which the latter is illustrated in FIGS. 5 and 6 are only necessary in the upper and lower end portions of the combined train assembly, where it is necessary to provide a conveying train run in which the upper and lower conveying strands 7 are sufficiently spaced apart to accommodate the diameter of the drive drum 8 and of the reversing drum 9. As can be seen from FIGS. 5 and 6, such an enlarged guide unit 13*b* has stretched lateral brackets 15*b* which are again interconnected by means of threaded spacer rods 16, but accommodate two appropriately spaced guide rollers 19, the remaining features of the assembly being similar to the earlier-described guide unit 13 (FIGS. 3 and 4).

The receiving unit 5 of FIGS. 1 and 2, adapted for the extraction of nodules 35 of manganese or some other ore, is illustrated in greater detail in FIGS. 7 through 11. This unit consists of a stiff supporting frame 36 composed of profile bars, the frame being supported on the ocean floor 4 by means of three skid-type supports. Two skids 37 support opposite lateral sides of the forward portion of the frame 36, while the third skid 37*a* is attached to the center of the frame rear portion. Instead of these skids, the frame may also be supported on suitable wheels, tracked chains, or rollers. On the supporting frame 36 are mounted two laterally spaced bearing pedestals 38 supporting the reversing drum 9 by means of bearings 39. On a special retaining frame attached to the bearing pedestals 38 are again arranged oppositely aligned pairs of retaining rollers 23 which cooperate with the reversing drum 9 in the same manner as they cooperate with the guide rollers 19 of the guide units 13, etc. On the rear portion of frame 36 is further provided a ballast package 41, situated preferably above the skid 37*a*, the ballast 41 being composed of several sections. Under certain circumstances, the ballast may be replaced by an accumulation of extracted material or rocks. The supporting frame 36 and its skids 37 and 37a, defining a plane of support 42, are preferably so arranged that a ground clearance *c* of approximately 40 to 70 centimeters is attained, the latter depending on the carrying capability of the ocean floor.

At a somewhat greater height *d* above the supporting plane 42 is further arranged a peripheral skirt 43, likewise composed of profile bars. This peripheral skirt 43 is attached to the supporting frame 36 and suspended from the bearing pedestals 38 by means of struts 44. The skirt 43 surrounds all parts of the receiving unit with a certain space therebetween. Its forward portion 45 is tapered in the manner of a ship's bow. The skirt 43 thus constitutes a lateral protective bumper for the movable and more sensitive parts of the receiving unit. The skirt 43 is further provided with a number of peripherally spaced pressure sensors 46 producing an electrical signal, when contact with an obstacle is established, the signals being transmitted to an appropriate indicating device on board ship, through one of the cables 18.

An additional signal, indicating the actual advance of the receiving unit on the ocean floor, may be obtained from one or several sensing wheels 47 which yieldingly engage the ocean floor, the sensing wheels 47 being preferably provided with radially extending pins, or the like, and connected to a transducer emitting a signal as a function of the rotation of the sensing wheels 47.

Figure 10:
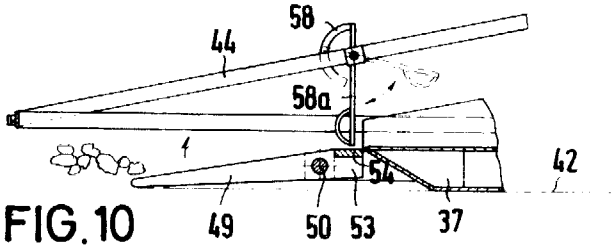
FIG. 10 illustrates a further enlarged detail of the front portion of the receiving unit of FIGS. 7-9, the unit being sectioned along line X—X of FIG. 8.
Figure 11:
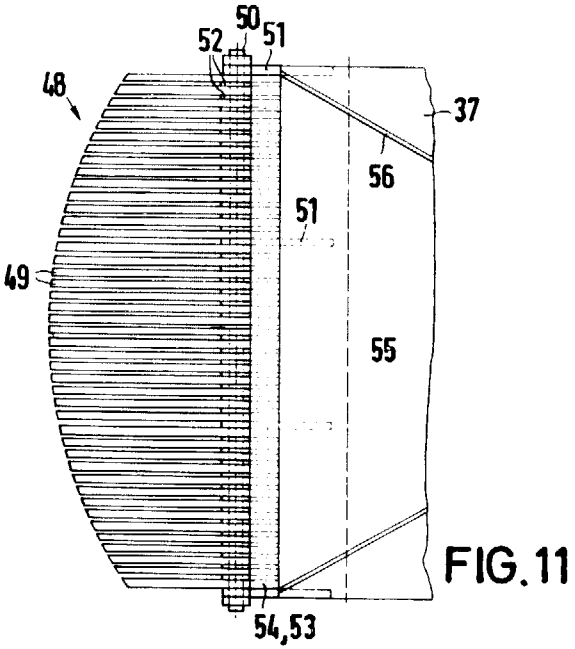
FIG. 11 is a plan view corresponding to FIG. 1, showing only the scraping device of the receiving unit.

On the forward portion of the supporting frame 36, just ahead of the skids 37, is arranged a scraping device 48 which is illustrated in more detail in FIGS. 10 and 11. This scraping device includes a plurality of forwardly extending fingers 49 in the form of flat, upended bars. These scraping fingers are arranged for pivoting motion on a common horizontal shaft 50, the latter being attached to the support frame 36 by means of support arms 51. Between the scraping fingers are arranged spacer blades 52, or the like, whose thickness is approximately equal to the thickness of the scraping fingers 39. The longer forward portions of the fingers 49 slant slightly downwardly, to about the level of the supporting plane 42 of the skids 37. Thus, when the receiving unit advances, these scraping fingers dig into the ocean floor just about as far as the skids penetrate, thereby lifting up the ore nodules lying on, or just under the surface of the ocean floor. The scraping fingers 49 have a limited vertical mobility. The plane of transverse alignment of the scraping device 48 is primarily determined by the two front skids 37, independently of the central rear skid 37*a*, because of the three-point contact between the supporting frame 36 and the ocean floor. The downward pivotability of the scraping fingers 49 under their own weight is limited by the abutment of their rearwardly extending abutment noses 53 against a stationary abutment profile 54 attached to frame 36. If it should happen that a scraping finger is lifted upwardly and remains in this position, the fact that its abutment nose 53 has thereby penetrated into the ocean floor, will tend to return the finger to its normal position, as a result of the advancing motion of the receiving unit. As can be seen in FIG. 11, the overall length of the scraping fingers 49 diminishes from the middle to both sides of the unit, but this feature may be adapted in accordance with specific operational requirements.

Behind the scraping device 48 is arranged a collecting ramp 55. The total space through which scraped-up deposits flow over this ramp is limited by two converging lateral guide panels 56 which form a transition to a longitudinally oriented central scooping trough 57, which later extends under the reversing drum 9 and is open to the rear of the receiving unit, so as to discharge any material which has not been scooped up by the passing conveying buckets.

Just above the collecting ramp 55 is further arranged a sensing gate 58a in the form of a horizontally pivoted pendulum, the sensing gate being connected to a potentiometer or some other signal generator, indicated schematically at 58. One of the cables 18 links this signal generator to a suitable indicator gauge on board ship, thus giving a reading of the height of the material stream passing over the collecting ramp 55.

Between the sensing gate 58*a* and the reversing drum 9 are arranged, on both sides of the movement path of the buckets 24, journalled guide rollers 59 for the conveying strands 7, the rollers 59 being mounted on the supporting frame 36. For the case, when the angle of the lower end of the combined guide train and conveying train assembly is shallow, these guide rollers 59 serve to lift the filled conveying buckets 24 over the incoming material stream, over the sensing gate 58a, and over the peripheral skirt 43.

The peripheral skirt 43 not only serves as a bumper, preventing damage to the receiving unit, but also acts as a means for a limited pre-sorting of the material deposited on the ocean floor, depending upon the height adjustment of the peripheral skirt in relation to the supporting plane 42. It is further possible to provide on the peripheral skirt 43 special deflecting members arranged at an appropriate height above the scraping device. These members prevent the pickup of very large nodules, whose diameter would exceed the capacity of the buckets 24, by laterally deflecting these large pieces. However, no serious risk is presented by the entry of such large nodules into the scooping trough, because the former are then simply lifted out over the lateral guide panels 56 of the scooping trough, by the motion of the buckets 24.

The towing forces exerted by the ship 1 are transmitted to the receiving unit 5 via the combined guide train and conveying train assembly. In order to obtain a certain lateral directional stability, the guide strands 12 are preferably attached to the lateral extremities of the supporting frame 36 and of the bearing pedestals 38. Similarly, the guide strands 12 are also attached laterally on the outside of the drive unit 2 on board the ship. It is preferable not to attach the guide strands 12 directly to the ship's hull, but to attach them to the supporting frame 60 of the drive unit 2. This support frame includes the bearings 61 for the drive drum 8 and for a gear train 62 which is driven by four drive motors 63. Also mounted on the supporting frame 60 is a transfer chute 65, leading to a conveyor belt 66 for the removal of the discharged material into a hold of the towing ship or into a separate, parallel-travelling cargo ship, for example.

Figure 9:
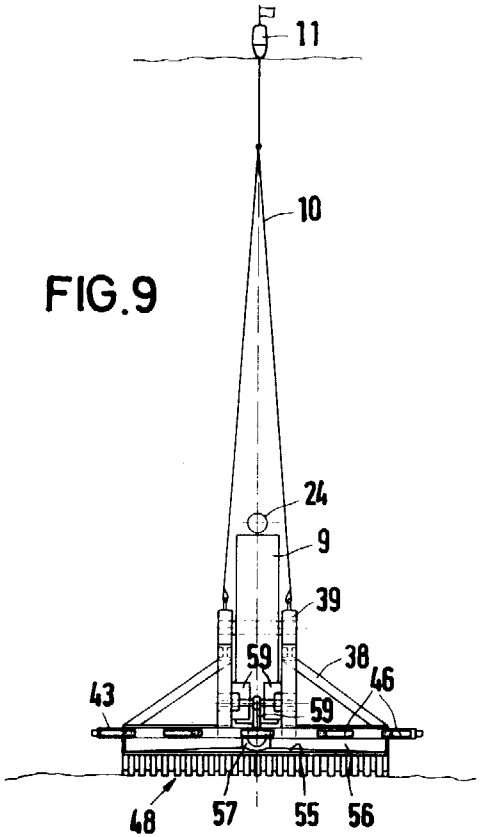
FIG. 9 shows the receiving unit of FIGS. 7 and 8 from the front.

The support frame 60, which carries the remaining parts of the drive unit 2, is readily detachable from the ship, through the arrangement of suitable mounting elements on the stern of the ship. When installing the device, it is thus possible to assemble the entire tow assembly, starting with the drive unit 2, and including the guide train assembly 3, the conveying train 6, the receiving unit 5, and the tensile connection 10 with the buoy 11, on land or in shallow water. Now, the drive unit 2 is attached to the stern of the ship, and the combined train assembly 3, 6, without any of the buckets 24 attached, as yet, is slowly developed, thereby also towing the receiving unit 5 far enough, until the tensile connection 10 to the buoy 11 is likewise taut. If the buoy 11 is carried by a suitably sized boat, or by a second ship, the entire tow train thus formed can be towed to the place of intended use. FIG. 9 shows that the tensile connection 10 is attached to both sides of the receiving unit 5, in order to give the latter sufficient stability and to hold it in approximately horizontal alignment. During towing of the entire train, or shortly before arrival at the place of use, the conveying buckets 24 can be attached to the conveying train 6, by intermittently advancing the latter and attaching the buckets 24, one by one.

Once arrived at the place of intended operation, the distance between the ship and the boat carrying the buoy is diminished, until the receiving unit 5 touches the ocean floor. During this operation, the on-board monitoring instruments, which are preferably combined in a single instrument panel on the bridge of the ship, are carefully watched. If one or several of the pressure sensors 46 on the peripheral skirt 43 indicate contact, it will be necessary to reposition the receiving unit, through maneuvers of the buoy-carrying boat. For a better supervision of the receiving unit 5, it is also possible to utilize closed-circuit television, radar instruments, and the like. These devices may be arranged just ahead of the receiving unit 5, on one of the guide units 13, and be aimed at the receiving unit and, if necessary, in the direction of forward advance.

At this point, the bucket conveyor, constituted by the earlier-described conveying train, is slowly put into motion, the drive motors 63 being operated at a speed corresponding approximately to a lineal conveying speed of 1 m sec. Thereafter, the ship's propulsion is adjusted for very slow forward motion, until the combined guide train and conveying train assembly is taut and the receiving unit 5 starts to move. As the receiving unit advances, the reading of the potentiometer 58, reflecting the height of the material stream flowing onto the receiving unit, is carefully watched, and the speed of the bucket conveyor is adjusted accordingly. The rate of advance of the receiving unit 5 is then increased until it reaches approximately 1 m/sec, while the speed of the bucket conveyor is adjusted to between 1.5 and 3 m/sec.

As they rotate around the reversing drum 9 of the receiving unit 5, the buckets 24 move from behind and above the reversing drum downwardly and forwardly into the scooping trough 57, scooping from the latter the already pre-sorted scraped-up materials. As a bucket is filled, its center of gravity shifts to the rearwardly located basket portion 31 of the bucket, so that, when the latter leaves the scooping trough, it tilts downwardly by the predetermined angle of pivotability of approximately 15 to 25°. The movement of the bucket conveyor creates two oppositely directed flows of water on the upper and lower sides of the conveying train. Water thus flows through the filled buckets from top to bottom, inspite of their tilted alignment, so that remaining picked-up fine granular material is washed out, leaving the buckets through the straining perforations 33. The result is that only pieces of a size larger than the diameter of the straining perforation 33 are delivered to the drive unit on board ship. The filled buckets 24 arrive on the drive drum from below, rotating around the upper arc of the latter, whereupon they are emptied through gravity discharge between the two groups of conveying strands 7, the discharged materials falling onto a transfer chute 65, from where they are conveyed further by means of a conveyor belt 66. If necessary, an additional washing device may be arranged on the lower side of the drive drum 8, in order to remove any residue sticking to the latter, to prevent the latter from becoming lodged in the guide grooves for the ropes, which could become damaged thereby.

In order to generate sufficient frictional force on the drive drum 8, it may be advantageous to provide tapered flanks on the grooves of the drum. Normally, the descending rope strands are subjected to sufficient pull from the empty buckets, to disengage the rope strands from the tapered grooves of drum 8. However, it is also possible to provide special separating rollers at that point between the drum and the descending rope strands.

As soon as the closed-circuit television image indicates an obstacle on the ocean floor which cannot be circumnavigated, or when the pressure sensors 46 indicate that the receiving unit 5 is stuck in place, it is first necessary to stop the conveyor drive and the ship's propulsion, whereupon the combined guide train and conveyor train assembly 3, 6 is relaxed through reversal of the ship's propulsion. The earlier-mentioned buoy boat again picks up the buoy, and as that boat is moved to the rear, the receiving unit 5 is lifted, whereupon it can be moved around the obstacles and repositioned for continued operation.

Because the total length of the train assembly for use in a tow-mining operation is normally at least 50% larger than the conveying height between the receiving unit 5 and the ship 1, and because the latter advances only at a rather small speed, the impact forces against an obstacle on the ocean floor are comparatively small, aided by the fact that, when synthetic ropes are used for the guide train and conveying train assembly, the latter stretch only gradually, so that the tension forces rise in a correspondingly slow fashion. Thus, there exists a good safety margin for stopping the ship, before the tension forces reach dangerously high levels.

The device of the invention preferably also includes means for monitoring the stretch behavior of the combined guide train and conveying train assembly. Such stretch sensors may be arranged directly on the guide strands 12, or this may be accomplished in a simpler way, through a device which compares a given length of the guide train assembly 3 with a reference length of an independent member. For this purpose, one may use a reference strand or tensile member, e.g. a steel cable, which extends approximately parallel to the guide strands 12 and which is connected to a sensing and indicating device arranged on board ship or on the drive unit. This sensing and indicating device preferably includes, as a connection, a resiliently yielding member, such as a tension spring, or a drum with a torsion spring.

Even though the initial tension surge occurs at the points of connection between the guide train assembly and the receiving unit 5, such tension propagates very fast along the strands and up to the drive unit 2. It has therefore been found adequate to attach one end of the aforementioned stretch-sensing cable at the uppermost guide unit **13*b* and to attach the upper end of the cable to a spring-loaded drum on board ship. The angular position of this drum then gives at all times a measure of the forces to which the guide strands 12** are subjected. This angular reading, or the measured rate of tension, can also be transmitted electronically to the central instrument panel on the bridge of the ship, or on some other suitable operator's stand which may be arranged in the immediate proximity of the drive unit. The speed of advance of the ship should then be adjusted primarily as a function of the measured tension in the guide train assembly, while the speed of conveyance is adjusted in accordance with the height of the material stream on the receiving unit, the latter adjustment being obtained automatically, if desired.

The path traveled by the receiving unit 5 on the ocean floor is normally determined by the course travelled by the ship. However, the receiving unit may be provided with limited steerability, in order to avoid a spotted obstacle in time. Such steering means may be constituted by a rudder which extends against the ocean floor and/or into the water current, thereby producing a moderate inclination of the supporting frame 36 in relation to the direction of pull on the combined guide train and conveying train assembly 3, 6. The force necessary for operating the rudder may be derived from either the water pressure on the bow, or from the rotation of the reversing drum 9. The steering adjustment can be operated either automatically, in response to sensors, or from aboard ship, in accordance with observations made. Under certain circumstances, it may then be necessary to correct the course of the ship in accordance with the direction of advance of the receiving unit 5.

When large ore fields are to be harvested, it is normally unavoidable that the paths of the receiving unit sometimes intersect. Since it is desirable to avoid travelling along curved paths as much as possible, the preference goes to either very large looping paths, one alongside the other, or to a spiral-shaped path. However, when it is necessary to exploit certain delimited fields with a minimum of operative effort, it may be necessary to sense the path previously travelled by the receiving unit. This can be done, either by depositing from the receiving unit signalling objects which can be sensed on the next run, or, in a simpler solution, by taking advantage of the observation that horizontal ground currents on the ocean floor may deposit on the previously travelled path such fine material as sand or sludge, but that no ore is redeposited thereon, so that the metal content in the previously harvested track is considerably less in comparison to the adjacent, unharvested area. This difference may be measured by means of appropriate sensors, indicating the change in the magnetic field strength, for example, or changes in radioactive emissions, using technology which is being used in connection with known copying processes. Using this type of sensor, it becomes possible to control a suitable steering mechanism of the receiving unit, even automatically, if necessary, so that the travelled path runs almost exactly alongside the previously travelled path of the receiving unit. This method makes it possible to harvest a certain area almost without leaving anything behind.

Figure 13:
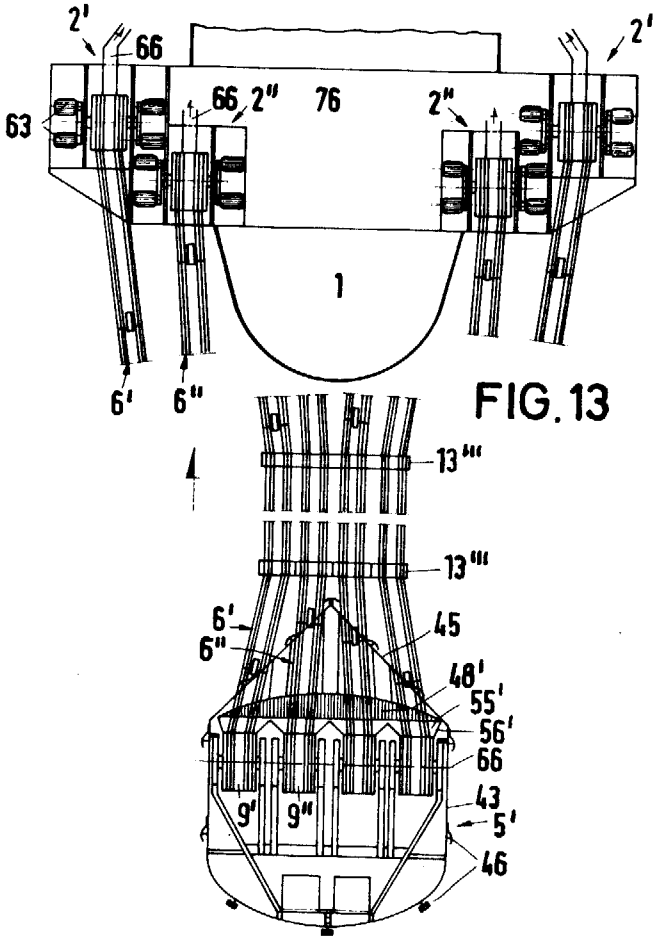
FIG. 13 illustrates the device of FIG. 12 as seen from above.
Figure 12:
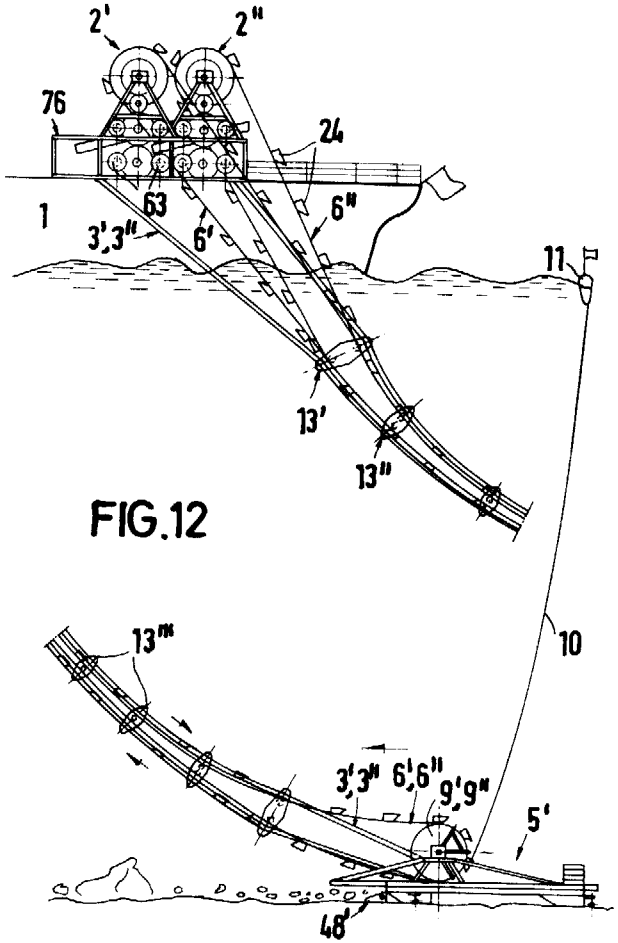
FIG. 12 shows a device similar to that illustrated in FIG. 1, but provided with four conveying trains.

In order to harvest as broad as possible a path in a single pass, one uses an embodiment of the type illustrated in FIGS. 12 and 13, in which four conveyor loops of equal construction but with separately controllable drive units 2' and 2'' are provided. These drive units are preferably arranged on a transverse bridge 76, mounted just ahead of the stern of the ship 1, the bridge 76 extending freely over both sides of the ship so that the drive units are located laterally outside and in a staggered position in relation to the center of the ship, in order to obtain a certain lateral distance between the guide train assemblies 3' and 3'' and the cooperating conveying trains 6' and 6'', on the one hand, and the side of the ship's hull, on the other hand. In their upper portions, these train assemblies have separate, independently mounted guide units. The guide train portions located further below, however, are preferably transversely linked by means of multiple, rigidly connected guide units 13'''.

The conveying strands of the four conveying trains 6' and 6'' pass over four identical reversing drums 9' and 9'' which are freely rotatable independently of each other on a horizontal shaft 66, mounted on the receiving unit 5'. The receiving unit has a common transverse scraping device 48' and a single collecting ramp 55' which is sub-divided by means of lateral panels 56' leading to four scooping troughs (not visible in the drawing), from which the material is scooped up by the conveyor buckets.

In deviation from the illustrated embodiment, it is also possible to arrange within a common supporting frame four independent bearing pedestals for the reversing drums and four associated scraping devices and collecting ramps which are adjustable relative to each other. It is, of course, also possible to provide several completely independent receiving units of the type illustrated in FIGS. 7–11, the units moving in a longitudinally and/or transversely staggered formation, and where the guide train and conveying train assemblies are similarly transversely interconnected by means of guide units 13'''.

Figure 14:
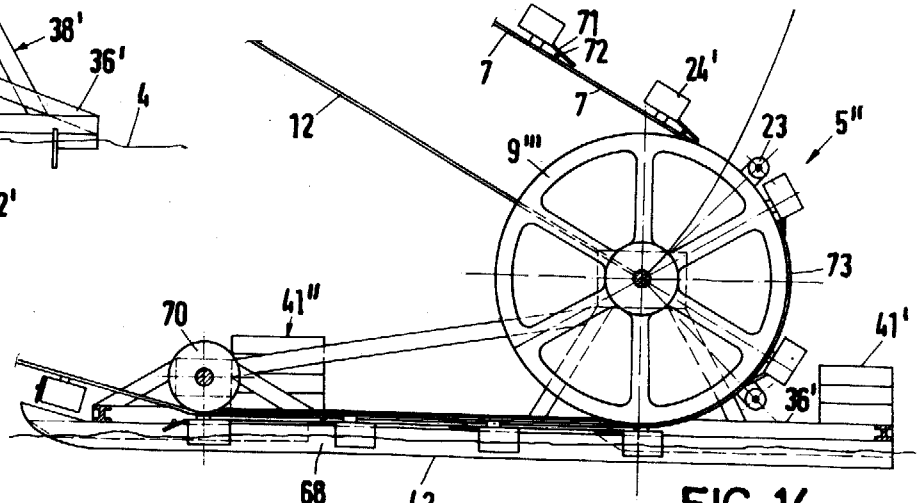
FIG. 14 shows a modified receiving unit for a device embodying the invention, as adapted for the extraction and conveyance of mineral soaps.
Figure 15:
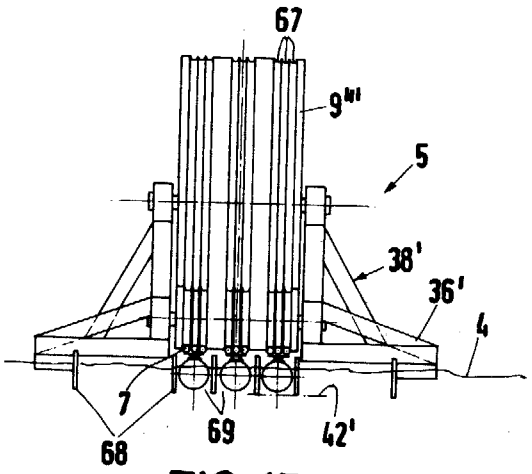
FIG. 15 shows the receiving unit of FIG. 14, as seen from the front end.

In FIGS. 14 and 15 is illustrated a modified receiving unit adapted especially for the harvesting of fine granular materials, such as mineral salts. This embodiment comprises a reversing drum 9''' which is journalled on a supporting frame 36', carrying suitable bearing pedestals 38'. This embodiment features three groups of rope grooves 67 for three conveying strands 7 each, of three separate conveying trains. The receiving unit is supported on the ocean floor only by means of longitudinally extending vertically oriented runner profiles 68, defining between them three scraping troughs 69 which are open in front and on the bottom.

The contact plane 42' defined by the runner profiles 68 is thus located a distance below the ocean floor 4, that distance depending upon the weight of the receiving unit 5''. The buckets 24' move forwardly through the scraping troughs 69, at a level somewhat above the contact plane 42' and parallel thereto, thereby being protected against any solid obstacles embedded in the ocean floor. The horizontal scooping path of the buckets is determined by the bottom periphery of the reversing drum 9''' and by a smaller guide drum which is similarly journalled on a horizontal transverse shaft and located forward of the reversing drum 5', the conveying strands 7 passing underneath guide drum 70.

The conveying buckets 24' used in this embodiment are water-tight containers, or at least only permeable to the extent of not loosing fine granular material. They are equipped with a hinged cover 71 which carries a transverse pin 72. On the descending run the hinged covers assume naturally their open position, and as soon as they reach the reversing drum 5'', their transverse pins 72 are engaged by a guide rail 73 which is arranged parallelly spaced in relation to the periphery of the reversing drum, so as to hold the hinged covers open, even though the buckets 24' are turned upside down, as they enter into the scraping trough 69, advancing horizontally parallel to the contact plane 42'. The guide rails 73 terminate in the vicinity of the guide drum 70, just ahead of the point where the buckets 24' are lifted out of the scraping trough 69, thus allowing the hinged covers to close. The latter remain closed during the entire ascending run of the conveyor, being opened again only after rotation around the drive drum on board ship, where the scooped-up material is discharged. The hinged covers may also be provided with a toggle spring mechanism which positively retains the hinged cover in either the open or closed position, in which case the guide rails 73 can be replaced by appropriate abutments effecting the opening and closing of the hinged covers 71. The peripheral skirt, the sensing devices, and other equipment previously described in connection with the receiving unit of FIGS. 7–11, are not illustrated in the embodiment of FIG. 14, for the sake of clarity of illustration. It will be noted that this embodiment, in addition to the rear ballast 41', also includes a front ballast 41'' in order to safely engage the runner profiles 68 against the ocean floor, under all angles of connection of the guide train and conveying train assembly.

Figure 16:
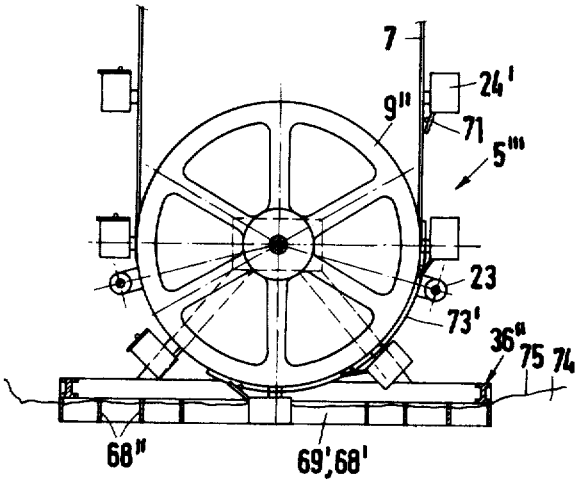
FIG. 16 illustrates another modified embodiment of the invention, the special receiving unit being adapted for the extraction and conveyance of ore sludge, the cross section shown following line XVI—XVI of FIG. 17.
Figure 17:
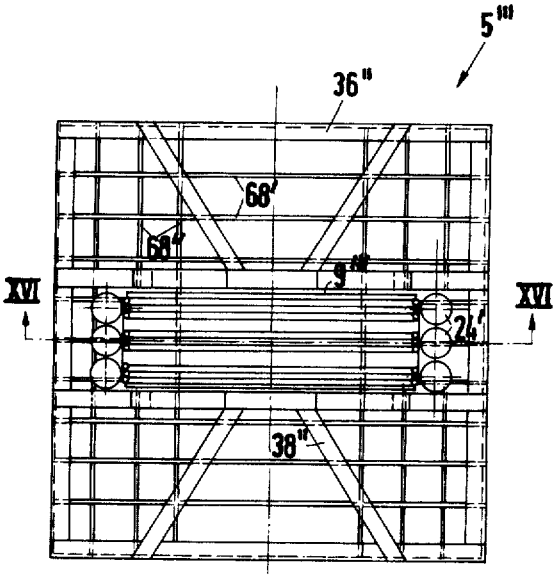
FIG. 17 shows the receiving unit of FIG. 16 in a plan view.

In FIGS. 16 and 17 is illustrated a third embodiment of a receiving unit, especially adapted for extracting and conveying ore sludge. This receiving unit 5''' consists of a supporting frame 36'' constructed of profile bars, and which has on its bottom side a grid of supporting profiles 68' and 68'' which again defines three adjacently located scooping troughs 69', the latter being enclosed on all sides, however. Between the bearing pedestals 38'' is arranged a reversing drum 9''' identical to the one of the previously described embodiment, the likewise identical buckets 24' dipping into the scooping troughs 69' in an arcuate motion around the reversing drum 9'''. In this case the guide rail 73' is so arranged that the hinged covers 71 are maintained open between their arrival on the reversing drum and their exit from the scooping troughs 69', whereupon they are automatically closed.

This special receiving unit 5''' needs only to be deposited on top of the sludge deposit 74. The conveying strands 7 are here shown to ascend and descend vertically between the drive drum and the reversing drum, but they should preferably be slanted at an angle of at least 10°, because, as the sludge is extracted, and a crater 75 is formed, without lateral motion of the receiving unit, the latter sinks deeper and deeper, while sludge flows into the crater from all sides. Thus, an entire sludge field can be dredged without any repositioning of the receiving unit.

In this type of embodiment, such devices as the peripheral skirt and other safety equipment are normally not necessary. It may be advantageous, however, to provide a means for the sensing of the sludge level. Also, for purposes of repositioning the receiving unit, it may be advantageous to provide a suitable tensile connection, linking it to a buoy.

In deviation from the receiving unit illustrated in FIGS. 7–11, it may be advantageous to provide on the receiving unit 5 a guide drum 70 of the type illustrated in FIG. 14, and disposed between the reversing drum 9 and the guide rollers 59. The purpose of such an additional guide drum would be to guide the buckets 24 on at least a short portion of their scooping path in parallel to the contact plane 42. This increase in the effective scooping path tends to improve the degree to which the buckets are filled. An additional guide means may be provided on the receiving units 5 and 5', in order to provide accurate guidance of the buckets 24 outside the reversing drum. Such guide means or supporting means may be arranged on the inside of the conveying train. One such possibility includes an endless band which is flexible only in one direction, and which runs over two idle reversing rollers, the conveying strands contacting the endless band, moving the latter through frictional engagement, while the band presents a flat supporting surface. Alternatively, a series of transverse supporting rollers may be arranged between the reversing drum and the guide rollers 59.

A still further improvement of the bucket guide means relates to a connection of the bucket attachments to the conveying strands not only in one transverse plane, but in two places which are offset in the longitudinal direction of the conveying ropes. This arrangement can be so designed that the flexibility of the conveying strands and their guide configuration around the reversing drum and the guide rollers is not adversely affected. For this purpose, it is also possible to arrange the connection between the conveying strands and the bucket attachments so that a limited longitudinal adjustability is provided on the second attachments points, with the result that the strands, subject to tension, are also evenly tensioned between the attachment points, without transmitting that tension to the bucket attachments, where unnecessary bending might otherwise occur.

Lastly, it is also possible to arrange the guide units in such a way that they may be adaptable for accommodating varying numbers of conveying strands, depending upon the particular circumstances. If it has been determined that, under maximum load, no more than five conveying strands should be used on each side of the buckets, then the guide rollers would be so designed that they have five guide grooves on each lateral end portion, and that, for an operation in which the assembly is subjected to lesser loads, as when materials are mined in shallower depths, only two, three, or four conveying strands are used on each side. Similarly, it may be advantageous to design the bucket attachments for the greatest number of conveying strands, when the highest loads are to be withstood, in order to permit the subsequent threading-in of the necessary additional conveying strands, which can then be connected to the bucket attachments.

Basically, the drive unit may be mounted on any kind of movable vehicle, such as one running along a bridge, or one travelling along the the shore of a body of water, either on rails or directly on the ground of the shore. Also, provision may be made for the receiving unit to be movable parallel to the drive unit. The receiving unit may for this purpose have a separate drive, or it may be linked to a boat which advances it approximately perpendicularly to the guide train assembly, in which case the reversing drum is oriented transversely to the direction of advance, while the scraping device remains on the forward portion of the unit. In this case, one of the two units must always be controlled in such a way that the guide train assembly remains taut so that it will not sag to the floor of the body of water. The drive unit should then be arranged in a sufficiently elevated position, or it may have to be mounted on an upwardly extending boom to which the guide train assembly is connected and from which the conveying train is guided downwardly to the lower drive unit. Of course, this alternative requires separate guide drums for the upper and lower conveying strands, the lower guide drum having an appropriate recess, or being in the form of two separate drum sections, in order to accommodate the suspended buckets carrying the scooped-up material. This embodiment permits operation of the device even in shallow waters, the device being thus also usable for a quick and efficient dredging of a shipping channel, or the like. In this context, it is also recommended to arrange the strand-guiding elements on the receiving unit and on the drive unit for limited swivel motion. If this is done, it becomes possible to operate with the drive unit remaining in place, while the area of a complete circular sector is dredged.

Figure 18:
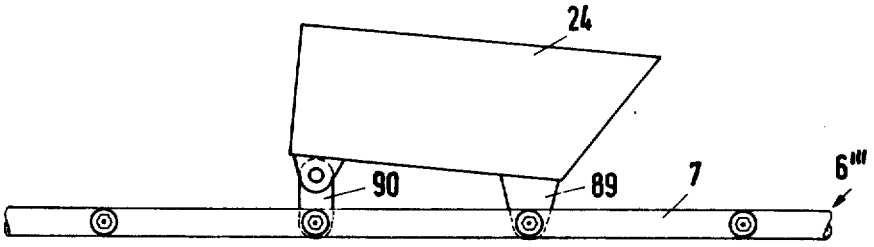
FIG. 18 illustrates a detail of a modified conveying train with a conveying bucket.
Figure 19:
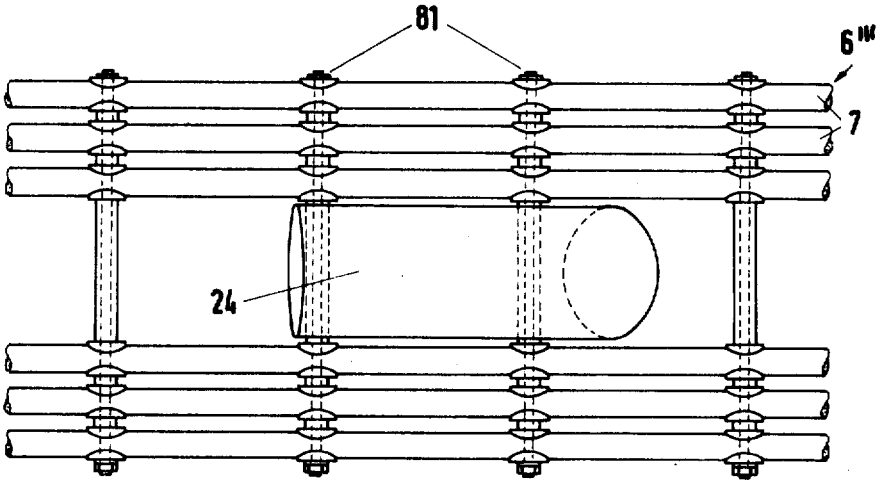
FIG. 19 is a plan view corresponding to the illustration of FIG. 18.
Figure 20:
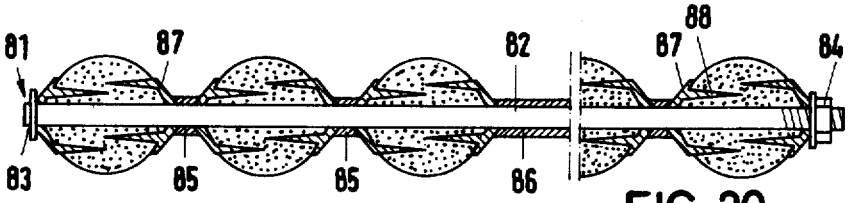
FIG. 20 shows in an enlarged cross section a transverse connector as part of the assembly shown in FIGS. 18 and 19.

In FIGS. 18 through 20 is illustrated a further improvement of a guide train assembly 16'''. Here, the conveying strands 7 are transversely interconnected by means of longitudinally regularly spaced transverse connectors 81. These transverse connectors, like the conveying strands themselves, may be fabricated of a multi-filament woven material; the embodiment of FIGS. 18–20, however, shows a spoke-type transverse connector 81 which includes a spoke rod 82 extending centrally through each one of the conveying strands 7, the rod 82 having a retaining ring 83 on one extremity and a threaded portion with a clamping nut 84 on the opposite extremity. The spoke rod 82 carries on it short spacer sleeves 85 positioned between the strands of each strand group, and a long spacer sleeve 86 positioned between the two innermost strands. The spacer sleeves are preferably of light metal. Between the extremities of the spoke rod 82, on the one hand, and between each end of a spacer sleeve and the adjacent flank of a strand 7, on the other hand, are further arranged special caps 87 which have each a number of prongs 88 penetrating laterally into the strand 7 from opposite sides thereof. This assembly produces a solid transverse connection between the spoke rod 82 and each conveying strand 87.

The transverse connectors 81 located between the strand groups are also conveniently usable for the attachment of the conveying bucket 24. For this purpose, each bucket has a forward connecting ear 89 attachable either to the midportion of the spoke 82, or to the long spacer sleeve 86, and a rear pivotable link 90 which similarly engages the next-following transverse spoke 81. The pivotable link 90 thereby compensates for any stretch of the conveying strands 7 in relation to the bucket attachment. In order to accommodate a limiting pivoting motion of the filled buckets in relation to the conveying strands 7, as described in connection with the first embodiment, it is further possible to provide for the buckets to be connected either only to a single transverse spoke 81, or to provide a knee-lever linkage between the rear portion of the bucket and the conveying train, the knee-lever linkage accommodating both the pivoting motion and the adjustment for longitudinal stretch of the conveying strands.

Independently of any tensions to which the conveying train may be subjected, the suggested transverse spokes 81 can be conveniently used as a means for positively driving the conveying train, in the manner of a chain-and-sprocket drive. For this purpose, it suffices to modify the drive drum so that the transverse spokes 81 engage the latter in a positive manner. This can be accomplished by adding longitudinal grooves in those portions of the drive drum which are located laterally outside the guide grooves for the conveying strands, or by providing on the drive drum separate, mechanically movable elements which produce the desired positive engagement under radial pressure, or also by using pressure-responsive elements, as for example, when the drive drum carries on its circumference an elastically deformable layer.

It should be understood, of course, that the foregoing disclosure describes only preferred embodiments of the invention and that it is intended to cover all changes and modifications of these examples of the invention which fall within the scope of the appended claims.

I claim:

1. A device for mining the ocean floor or the bottom of some other body of water for ore nodules, mineral soaps and ore sludge by extracting these deposits and conveying them upwardly to a ship or some other suitable carrier, the device comprising in combination:

a drive unit adapted for mounting on board the ship;

a receiving unit arranged for placement on the ocean floor;

a guide train assembly extending between the drive unit and the receiving unit;

an endless conveying train extending along the guide train assembly between the drive unit and the receiving unit and having descending and ascending conveying strands with conveying receptacles attached thereto; a drive drum on the drive unit and a reversing drum on the receiving unit guiding the upper and lower end portions of the conveying train; and means defined by the guide train assembly for guiding the descending and ascending strands of the conveying train therealong, so as to prevent interference between the strands; and wherein:

the combined comveying train and guide train assembly is flexible, the conveying train and the guide train assembly having flexible, tension-transmitting conveying strands and guide strands, respectively;

the guide strands of the guide train assembly, form a tensile link between the ship and the receiving unit, thereby determining the path of the conveying train between the receiving unit and the drive unit; and the receiving unit includes means for extracting deposits from the ocean floor into the conveying receptacles.

2. An underwater mining device as defined in claim 1, wherein:

the guide strands and the conveying strands are multi-filament rope-like members, of a synthetic plastic material selected from the group consisting of polypropylene and polyamide.

3. An underwater mining device as defined in claim 2, wherein the strands include, among their plastic filaments, reinforcing filaments of highly resistant fibrous material.

4. An underwater mining device as defined in claim 1, further comprising a floating body which includes a tensile connection to the receiving unit, the tensile connection, when pulled, being capable of lifting and repositioning the receiving unit.

5. An underwater mining device as defined in claim 4, wherein:

the floating body is a buoy;

the tensile connection is a cable; and the device further comprises a boat for controlling the position of the buoy in relation to the ship.

6. An underwater mining device as defined in claim 1, wherein the conveying train includes an endless conveyor loop formed of two groups of parallel strands, with one or more strands in each group, the loop including means for transversely interconnecting the parallel strands and means for attaching the conveying receptacles to the strands.

7. An underwater mining device as defined in claim 6, wherein:

the conveying receptacles are elongated buckets;

the two groups of strands are spaced apart a distance, and the buckets are attached centrally between the strand groups; and the receptacle attaching means includes a series of bucket attachments fastened to the strands at regular intervals.

8. An underwater mining device as defined in claim 7, wherein each bucket attachment includes means for pivotably connecting the bucket to the strands, by defining a transverse pivot axis around which the bucket is pivotable within a limited angle of freedom relative to the conveyor loop.

9. An underwater mining device as defined in claim 6, wherein the transverse strand connecting means includes a series of transverse connectors, forming cross-links between all the strands of the conveyor loop, the connectors being arranged at regular intervals along the conveyor loop.

10. An underwater mining device as defined in claim 9, wherein:

each transverse connector includes:

a rigid spoke rod extending centrally through each conveying strand;

clamping caps arranged on the spoke rod and engaging each strand from both sides; and means for clampingly positioning the clamping caps and the strands confined between them in the transverse direction.

11. An underwater mining device as defined in claim 10, wherein:

the two groups of conveying strands which define a conveyor loop are spaced apart a distance equal to several times the diameter of a strand, and each group includes at least two strands;

the clamping caps of the transverse connectors include each a plurality of laterally extending pointed prongs penetrating laterally into a strand, when clamped thereagainst; and the clamping cap positioning means include spacing means between the strands of each group and between the strand groups.

12. An underwater mining device as defined in claim 10, wherein the drive drum of the drive unit includes on its periphery a series of annular guide grooves for receiving therein the flexible conveying strands of the conveyor loop, and further, means for positively entraining the conveyor loop, by engaging the rigid spoke rods of its transverse connectors.

13. An underwater mining device as defined in claim 9, wherein:

the conveying receptacles are elongated buckets;

the two groups of strands are spaced apart a distance, and the buckets are attached centrally between the strand groups; and the receptacle attaching means includes a series of bucket attachments defined by at least some of the transverse connectors.

14. An underwater mining device as defined in claim 13, wherein:

two successive transverse connectors define upper and lower bucket attachments, in the sense of bucket orientation on the ascending conveying strand; and the lower bucket attachment includes an intermediate attachment link for the accommodation of elongation of the conveying strand portions located between the upper and lower bucket attachments.

15. An underwater mining device as defined in claim 1, wherein the guide train assembly includes at least four guide strands and a number of guide units disposed at intervals along the length of the strands between the drive unit and the receiving unit and means for attaching the guide strands to the guide units, each guide unit including means for separately guiding the conveying strands.

16. An underwater mining device as defined in claim 15, wherein:

each guide unit includes a guide cage surrounding the ascending and descending strands of the conveying train, and means for clampingly attaching the guide strands to said cage;

the conveying strand guide means includes at least one guide roller disposed transversely in each guide cage between the ascending and descending strands so as to guide the latter, and means for retaining said strands against the guide rollers.

17. An underwater mining device as defined in claim 16, wherein:

the conveying train includes at least two transversely spaced, parallel ascending and descending conveying strands forming an endless conveyor loop; and the guide rollers have annular guide grooves for the multiple strands.

18. An underwater mining device as defined in claim 17, wherein:

each guide cage includes two lateral brackets, spaced apart a distance to accommodate the conveying strands therebetween, and several spacer rods extending between the brackets;

the guide strand attaching means are clamping shoes arranged on said brackets;

the guide rollers are journalled on the spacer rods; and the conveying strand retaining means includes at least two pairs of retaining rollers for the ascending and descending strands, each pair of retaining rollers being oriented parallel to and spaced from the guide rollers so as to accommodate the conveying strands therebetween, and mounted in a cantilever-type attachment on opposite bracket faces, the length of the retaining rollers being such that a central axial gap is defined between each roller pair.

19. An underwater mining device as defined in claim 18, wherein:

the conveying receptacles are buckets attached at regular intervals to the conveying strands; and each bucket includes a bucket attachment connected to the parallel strands, the bucket attachment being T-shaped in profile, having an upstanding central ridge adapted to freely pass through the axial gap between the retaining rollers, and a flange portion attached to the conveying strands adapted to pass between the guide rollers and the retaining rollers.

20. An underwater mining device as defined in claim 18, wherein:

the conveying receptacles are buckets attached at regular intervals to the conveying strands;

the conveying strands include a series of transverse connectors with rigid spoke rods extending through all the strands of the conveyor loop; and each bucket includes a bucket attachment engaging two successive transverse connectors, the bucket attachment being shaped to freely pass through the axial gap between the retaining rollers, and the transverse connector being shaped to pass between the guide rollers and the retaining rollers.

21. An underwater mining device as defined in claim 15, wherein:

the conveying train includes several conveyor loops with independently movable ascending and descending conveying strands and conveying receptacles attached to each conveyor loop; and at least some of the guide units of the guide train assembly include means for guiding, within one rigidly connected structure, all the strands of the several conveyor loops.

22. An underwater mining device as defined in claim 21, wherein:

the drive unit includes separate drive drums and drive means for each conveyor loop; and the receiving unit includes separate reversing drums for each conveyor loop.

23. An underwater mining device as defined in claim 21, wherein:

several similar drive units are arranged for mounting on board the same ship, in a staggered formation.

24. An underwater mining device as defined in claim 1, wherein:

the receiving unit further includes:

a generally rigid, substantially horizontal supporting frame;

means defined by the supporting frame for engaging the ocean floor on at least three spaced-apart points so as to define a supporting plane against the ocean floor, the deposit extracting means being located beteween the floor engaging means;

a substantially horizontally oriented journal support for the reversing drum connected to the supporting frame and arranged so that the periphery of the drum reaches near the level of the deposits on the ocean floor.

25. An underwater mining device as defined in claim 24, wherein the supporting frame extends a distance behind the reversing drum axis and carries thereon a ballast for stabilizing the receiving unit.

26. An underwater mining device as defined in claim 24, wherein:

the receiving unit is primarily designed for the extraction of ore nodule deposits during movement along the ocean floor, to which end the mining device further includes means for advancing the receiving unit along the ocean floor; and the extracting means of the receiving unit includes:

scraping means arranged on the forward portion of the supporting frame for scraping ore nodule deposits from the ocean floor, as the receiving unit advances;

a collecting ramp arranged centrally behind the scraping means so as to receive and collect the scraped-up deposits therefrom; and a scooping trough arranged behind the collecting ramp and located underneath the reversing drum; and wherein the conveying receptacles are conveyor buckets, moving around the reversing drum in a guided path from above and behind the latter, down and underneath it, and forward through the scooping trough, where they scoop up the extracted deposits, and from where the filled buckets ascend to the ship.

27. An underwater mining device as defined in claim 26, wherein the scraping means includes a plurality of parallel, forwardly extending scraping fingers, the fingers being laterally spaced apart in the manner of a comb and independently movable upwardly in response to obstacles on the ocean floor.

28. An underwater mining device as defined in claim 27, wherein:

the scraping fingers are pivotably supported on a common horizontal pivot axis arranged near their rear end; and the scraping means further includes an abutment for defining the lowest position of the scraping fingers as a slightly downwardly slanting orientation in the forward direction, and means for biasing the fingers against this abutment.

29. An underwater mining device as defined in claim 26, wherein:

the receiving unit further includes:

means for sensing the quantity of scraped up deposits moving over the collecting ramp into the scraping trough; and means for transmitting the information to the ship.

30. An underwater mining device as defined in claim 29, wherein:

the sensing means includes a pivotable sensing gate suspended on a horizontal pivot axis above the extracting means in the manner of a pendulum so as to be swung rearwardly by the scraped-up deposits passing underneath; and the information transmitting means includes an angular motion transducer connected via an electric cable to the ship.

31. An underwater mining device as defined in claim 24, wherein:

the supporting plane defined by the ocean floor engaging means includes two laterally spaced skids under the forward portion of the supporting frame and one central skid under the rear portion of the supporting frame; and the journal support for the reversing drum is located closer to the front skid than to the rear skid.

32. An underwater mining device as defined in claim 24, wherein:

the receiving unit further includes a pressure-resistant peripheral skirt enclosing its supporting frame with a peripheral gap therearound;

the peripheral skirt is attached to the supporting frame at a distance above the plane of support against the ocean floor; and the outline of the peripheral skirt includes a pointed forward portion for the deflection of obstacles or of the receiving unit.

33. An underwater mining device as defined in claim 32, wherein:

the peripheral skirt includes, at least on its front and lateral portions, several pressure sensors responding, when pressure contact with obstacles on the ocean floor is made; and the pressure sensors include indicators on board ship to which they are connected via an electric cable.

34. An underwater mining device as defined in claim 24, wherein:

the receiving unit is primarily designed for the extraction of mineral soap deposits during movement along the ocean floor, to which end the mining device further includes means for advancing the receiving unit along the ocean floor;

the ocean floor engaging means is constituted by several longitudinally extending, generally vertically oriented, narrow runner profiles defining a supporting plane against the ocean floor which lies a distance under the mineral soap deposits on the ocean floor;

the conveying receptacles are conveyor buckets moving around the reversing drum; and the journal support for the reversing drum is so arranged that the buckets, when they move through the lowermost arc portion on the reversing drum, reach approximately as deep into the deposits on the ocean floor as the runners.

35. An underwater mining device as defined in claim 34, wherein:

the extracting means of the receiving unit includes a longitudinal scraping trough defined between two of said runners which are spaced apart a distance somewhat larger than the diameter of the conveyor buckets and arranged on opposite sides of their path; and the receiving unit further includes a guide drum for the ascending conveying strands arranged on the forward portion of its supporting frame and engaging the conveying strands so that the latter and their attached buckets, before ascending to the ship, move substantially horizontally through the scraping trough in their path between the reversing drum and the guide drum, thereby scraping and scooping up deposits.

36. An underwater mining device as defined in claim 34, wherein:

the conveying buckets attached to the conveying train include pivotably openable lids;

the bucket lids and the receiving unit define means for maintaining said lids open, independently of the influence of gravity, when the buckets reach into the deposits on the ocean floor.

37. An underwater mining device as defined in claim 24, wherein:

the receiving unit is primarily designed for the extraction of ore sludge deposits, to which end the supporting frame and its ocean floor engaging means define a vertically open grid structure, thus permitting the receiving unit to sink into the deposits to a depth at which the lower periphery of the reversing drum is at least very close to the deposits;

the grid structure includes a downwardly open scooping trough underneath the reversing drum serving as the extracting means; and the conveying receptacles are conveyor buckets moving around the reversing drum and into the scooping trough, thereby scooping up deposited sludge from the ocean floor.

38. An underwater mining device as defined in claim 1, further comprising:

a drive unit support frame mountable on board the ship in a cantilever fashion, so as to permit positioning of the drive unit in an overhanging arrangement on the ship; and means for receiving the extracted deposits, as they are discharged from the conveying receptacles, and for transferring them away from the receiving unit.

39. An underwater mining device as defined in claim 38, wherein:

the deposits receiving and transferring means includes a receiving chute mounted underneath the point at which the conveying receptacles discharge their contents, and a transfer conveyor receiving the discharged deposits from the receiving chute.

40. An underwater mining device as defined in claim 38, wherein:

the drive unit support frame and the drive unit with its drive drum and driving means form an integral assembly which is readily removable from the ship as a mounting unit.

41. An underwater mining device as defined in claim 1, wherein the conveying strands of the conveying train and the guide strands of the guide train assembly have approximately the same elongation characteristics under operation.

* * * * *